US005119654A

United States Patent [19]

Ceron et al.

[11] Patent Number: 5,119,654

[45] Date of Patent: * Jun. 9, 1992

[54] CYLINDER LOCKS HAVING REMOVABLE LOCK BARRELS

[75] Inventors: Daniel Ceron, Bastogne; Christian Lodomez, Cherain, both of Belgium

[73] Assignee: Euro-Locks, S.A., Bastogne, Belgium

[ * ] Notice: The portion of the term of this patent subsequent to Dec. 11, 2007 has been disclaimed.

[21] Appl. No.: 625,499

[22] Filed: Dec. 11, 1990

[51] Int. Cl.[5] ..... E05B 29/02

[52] U.S. Cl. ..... 70/369; 70/421

[58] Field of Search ..... 70/367, 368, 369, 421

[56] References Cited

U.S. PATENT DOCUMENTS

| | | | |
|---|---|---|---|
| 1,853,403 | 4/1932 | Briggs | 70/367 |
| 1,990,934 | 2/1935 | Falk | 70/369 |
| 2,046,831 | 7/1936 | Lowe | 70/369 |
| 2,065,683 | 12/1936 | Gahagan | 70/369 |
| 2,391,833 | 12/1944 | Johnstone | 70/367 |
| 4,630,457 | 12/1986 | Kincaid et al. | 70/369 |
| 4,809,525 | 3/1989 | Cox | 70/369 |
| 4,976,123 | 12/1990 | Ceron et al. | 70/369 |

*Primary Examiner*—Rodney M. Linsey
*Assistant Examiner*—D. M. Boucher
*Attorney, Agent, or Firm*—Leonard Bloom

[57] ABSTRACT

A cylinder lock having a removable barrel that includes a control tumbler. The barrel is retained in the housing of the lock by a nib that is formed on either the barrel or the interior of the housing. A longitudinal nib slot is formed on the other of either the barrel or the interior of the housing. The nib and the nib slot are aligned with one another only when the barrel is in an unlocking position for permitting the barrel to be removed from the housing. In this manner, the barrel may be removed from the housing only when both the barrel is in the unlocked position and when a special control key has been inserted into the barrel for withdrawing the control tumbler into the barrel.

8 Claims, 5 Drawing Sheets

CYLINDER LOCKS HAVING REMOVABLE LOCK BARRELS

FIELD OF THE INVENTION

The present invention relates to key-activated cylinder locks having a removable barrel and, in particular, to arrangements for removably retaining the lock barrels of such locks in the barrel housings thereof.

BACKGROUND OF THE INVENTION

The use of cylinder locks having a removable lock barrel is well known. Typically, in such locks the barrel is removably retained in the housing by a tumbler that is in the form of a control tumbler. When eccentrically displaced under the action of a spring, this control tumbler projects outwardly from the substantially cylindrical barrel (so that the control tumbler is extended relative to the barrel) and collaborates with a stop or a shoulder (wall) defined by a groove that is formed in the housing for preventing the removal of the barrel from the housing. In this fashion, the accidental removal of the lock barrel is prevented.

U.S. Pat. No. 2,061,456 issued to Falk discloses such a lock having a removable barrel with a control tumbler in which an extending end thereof is always extended relative to the barrel. The extending end has a pair of opposite rounded shoulders, so that the width of the extending end is reduced relative to the remainder of the control tumbler. When in the locking position, the extending end abuts a wall or shoulder that is formed in the barrel. In an unlocking position, the extending end coacts with slanted edges of a longitudinal slot, permitting removal of the barrel. In this fashion, the barrel can only be removed from the housing when the barrel is in the unlocked position, thereby preventing the accidental removal of the barrel when it is in the locked position.

U.S. Pat. No. 4,398,405 issued to Patriquin, provides a lock having a removable barrel equipped with a control tumbler that has a first end and a second opposite end. In one position, the first end is extended and the second end is retracted relative to the barrel, so that the barrel is retained in the barrel housing. In another position, the first end is retracted and the second end is extended relative to the barrel, so that the barrel may be removed from the housing. The first end of the control tumbler has a width that is greater than the width of the second end. Normally, the control tumbler is in the one position. Only when an appropiate key is inserted, is the control tumbler driven into the second position wherein the lock barrel may be removed. The barrel housing has at least one longitudinal slot formed therethrough. If a second longitudinal slot is provided, it terminates short of the end of the housing. When the first end is retracted and the extended second end is aligned with the longitudinal slot, the barrel may be removed from the housing.

While each of the above disclosures is useful for its intended purposes, they also have several disadvantages.

First, the barrels of such locks include a pair of opposite matched longitudinal slots that are intended to receive therein the various portions of the combinating tumblers of the barrel. In order to prevent the accidental removal of the lock barrel, at least one of the pair of matched longitudinal slots must terminate short of the annular groove while the other slot of the pair is in communication with the annular groove. Such an arrangement requires specialized tooling of the housing and/or the placement of specialized stops and inserts in the housing. This creates significant problems in manufacturing standardization and requires an increase in parts and inventories.

A second disadvantage regards the use of the control tumblers as the sole means for retaining the barrels in the housings thereof. In such locks, forced removal of the barrels from these locks places pressure on the control tumblers. Because these tumblers are often fabricated from steel and brass, while the barrels and housings are fabricated from a die cast zinc alloy, these tumblers are readily subject to deformation resulting from purposeful or accidental acts, such as overpushing of the key, overpulling of the barrel, etc.

Additionally, in the event that the system is of the type (such as Patriquin '405) that utilizes a first common key for locking and unlocking functions and a second key for removal functions, then anyone equipped even with only an appropiate second key (which is often a key that has simplified contours and, as such, is readily susceptible to being counterfeited) is able to dislodge and remove any of the barrels of the locks of the system, regardless whether the locks are locked or unlocked.

Finally, in an arrangement, such as that disclosed in Patriquin '405, in order to provide the appropiate annular groove, an arrangement is disclosed wherein the groove is open to the environment. Such a feature is not adaptable for use in locks having exterior applications, where it is exposed to the elements, such as snow, rain, etc., that can enter the internal workings thereof via the groove, thereby damaging the working of the lock. Also, the arrangements of Patriquin '405 require that different types of control tumblers and longitudinal slots be utilized depending on whether the barrel of the lock is to be rotatable 90°, 180°, 360°, etc. This creates further problems not only with manufacturing standardization, but also requires that a considerable inventory of parts, for the various tumblers, etc., of the locks be maintained.

Thus, it can be seen that there remains a need for a lock having a lock barrel which is removable therefrom only when in the unlocked position, which is capable of being fabricated so that it does not present problems with manufacturing standardization and maintainance of parts inventory, and which does not rely solely on the use of a control tumbler to retain the lock barrel in the housing, so as to be capable of withstanding greater amounts of stress than those of the prior art.

SUMMARY OF THE INVENTION

Accordingly, it is the primary object of the present invention to provide a cylinder lock having a removable barrel in which the barrel is removably retained in the housing by an arrangement that utilizes element (s) other than a control tumbler as the primary means for retaining the barrel in the housing, so that a retaining means is provided that is capable of withstanding increased amounts of pressure, and further so that the lock barrel cannot be partially dislodged from the housing during locking and unlocking operations.

It is still another primary object of the present invention provide such a lock that has a housing, a removable barrel and sliding combinating tumblers, and in which the removable barrel may be easily installed or replaced only when the lock barrel is in an unlocked position.

It is another object of the present invention to provide a lock which can be easily fabricated without encountering problems with manufacturing standardization, and which utilizes standardized parts that are adaptable for use in a wide variety and range of locks, thereby reducing problems with inventory.

It is a still further object of the present invention to provide a lock which is simple to manufacture and does not require inserts or piece for abutment, even when a 360° annular rotation of the annular groove is provided.

In accordance with the teachings of the present invention, there is disclosed a cylinder lock having a removable barrel. The lock barrel includes a plurality of sliding combinating tumblers that are disposed in the barrel for sliding movement between respective first resting and second activated positions. A housing has a bore formed therethrough for rotatably receiving the barrel therein. The housing further has an internal longitudinal slot formed therein extending from a forward end of the housing. When the barrel is disposed in the housing with at least a portion of the combinating tumblers in the respective resting positions thereof, the combinating tumblers in the resting positions are received in the slot for preventing rotational movement of the lock barrel in the housing for the locking and unlocking thereof. A nib is formed on one of either the lock barrel or the interior of the housing. A longitudinal nib slot is formed in the other of either the lock barrel or the interior of the housing. An annular clearance space is also formed in the other of either the lock barrel or the interior of the housing, either rearwardly or forwardly of the nib slot and being in communication therewith. When the lock barrel is disposed in the housing, the nib is received in the annular clearance slot for permitting the rotation of the barrel in the housing between a first locking position and a second unlocking position. The nib is also positioned so as to be substantially aligned with the nib slot only when the lock barrel is in the second unlocking position. In this fashion, the lock barrel may be removed from the housing only when the barrel is in the unlocked position.

In one preferred embodiment, the nib is formed on the barrel and both the nib slot and the annular clearance space are formed in the housing with the annular clearance space being located rearwardly of the nib slot.

In another preferred embodiment, the nib is formed on the interior of the housing and both the nib slot and the annular clearance space are formed on the lock barrel with the annular space being located forwardly of the nib slot.

In further accordance with the teachings of the present invention, an improvement upon a conventional cylinder lock having a removable lock barrel with a control tumbler is disclosed. The improvement upon such a lock includes a nib that is formed on either the interior of the housing or the lock barrel. An annular clearance slot and a longitudinal nib slot are both formed in the other of either the interior of the housing or the lock barrel. If the longitudinal nib slot and the clearance space are formed in the lock barrel, the slot extends from a rearward end of the barrel to the annular clearance space, so as to be in communication therewith. If the longitudinal nib slot and the clearance space are formed in the housing, the slot extends from a forward end of the housing to the annular clearance space. In this fashion, when the lock barrel is disposed in the housing, the nib is received in the annular clearance space permitting the rotation of the barrel in the housing between a first locking position and a second unlocking position. Finally, the nib is positioned so as to be substantially aligned with the nib slot only when the lock barrel is in the second unlocking position, whereby the lock barrel may be removed from the housing only when both the barrel is in the unlocked position and when the control tumbler is moved into the activated condition with the key.

These and other objects of the present invention will become readily apparent from a careful reading of the following specification taken in conjunction with the enclosed drawings.

DESCRIPTION OF PREFERRED EMBODIMENTS

Figure 1A:
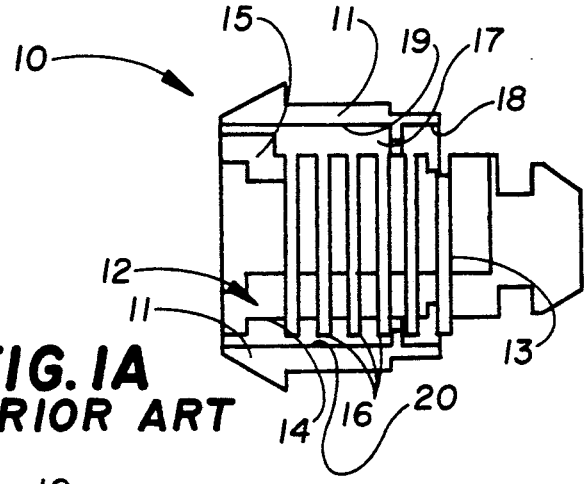
FIG. 1A PRIOR ART
FIG. 1A is a longitudinal cross-section of a conventional cylinder lock having a removable barrel and a control tumbler.
Figure 1B:
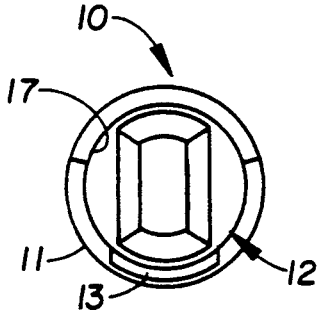
FIG. 1B PRIOR ART
FIG. 1B is an end view of the lock of FIG. 1A.

Referring now to the drawings, and in particular, to FIGS. 1A, 1B, 2A, 2B, 3A and 3B a conventional cylinder lock 10 of the type having a housing 11 that rotatably receives and houses therein a removable barrel 12 that includes a control tumbler 13, is illustrated.

The lock barrel 12 of the lock assembly 10 is substantially cylindrical in shape having a curvature 14. The lock barrel 12 includes a body 15 and a plurality or series of sliding (combinating) tumblers 16. Tumblers 16 are disposed in the body 15 for sliding movement between respective first resting positions, wherein the rotation of the lock barrel 12 in the housing 11 is prevented, and second activating positions, wherein the rotation of the barrel 12 in the housing 11 is permitted, in a manner that is well known to those skilled in the art.

In such locks 10, the control tumbler 13, is slidably disposed in the body 15 normally being located behind (rearwardly of) the tumblers 16. The curvature of the edge of the control tumbler 13 is, preferably, substantially identical to the curvature 14 of the body 15 of the barrel 12. The control tumbler 13 is further retained in the barrel 15 by the mechanical means (not illustrated), that are also well known to those skilled in the art. Preferably, this tumbler 13 is normally maintained in a position that is substantially eccentric relative to the tumblers 16.

It is noted that while described herein as a barrel having a control tumbler, if desired, a conventional lock that has a removable barrel but does not have a control tumbler may also be utilized.

It is further noted that while the control tumbler 13 described herein is a one-ended control tumbler, such as that which is disclosed in Falk '456, alternatively, a double-ended control tumbler, such that which is disclosed in Patriquin '405 may also be utilized. Either of these types of control tumblers equally provides the desired result—that is, that the arrangement (the nib/nib slot/annular clearance space) of the present invention provides the primary means for removably retaining the barrel in the housing. Additionally, the provision of the control tumbler 13 advantageously provides a second, safety structure for removably retaining the barrel in the housing.

The housing 11 of the present invention has a bore 17 formed therethrough for rotatably receiving the barrel 12 therein. The barrel 12 is removably retained in the housing 11 by the collaboration (abutment) of the control tumbler 13 with a rim that is defined by a peripheral (annular) space 18 that is formed in the bore 17 or located (defined) at the end of the bore 17, being defined by an annular clearance space 18. This annular clearance space 18 is sized to accomodate the extension of the first end of the control tumbler 13. In this fashion, when this control tumbler 13 is in the resting position thereof, wherein the control tumbler 13 extends outwardly from the body 15 of the barrel assembly 12, it is received in the annular clearance space 18 that is located rearwardly of the slot 19. Further, in this manner, removal of the barrel assembly 12 from the housing 11 is prevented when the control tumbler 13 is in the resting position thereof.

An (first) internal longitudinal slot 19 is formed in the housing 11 extending rearwardly from a one end (a forward end) of the bore 17 of the housing 11. This slot 19 is in open communication with the bore 17 that is formed through the housing 11. The width of this slot 19 is always less than the width of the control tumbler 13.

A second internal longitudinal slot 20 may also be formed in the bore 17 of the housing 11 diametrically opposite of the first slot 19. This second slot 20, like the first slot 19, extends rearwardly from the forward end of the bore 17 of the housing 11.

The first slot 19 and the second slot 20 are sized to accomodate the extension of the various combinating tumblers 16 in their resting position. While shown herein as terminating short of the rearward end of the housing 11, in the event that a double-ended control tumbler is utilized, then the first slot 19 will extend to the clearance space 18 through the rim. However, unlike the first slot 19, this second slot 20 will terminate short of the annular clearance space 18, being separated therefrom by the rim.

It is also noted that as long as the first end of the control tumbler 13 has a width that is greater than the width of the slots 19 and 20 then, if desired, both of the slots 19 and 20 could extend through the rim. However, such an arrangement is not preferred.

In this fashion, in the respective resting positions thereof, at least a portion of the combinating tumblers 16 extends from the diameter (curvature) 14 of the body 15 of the barrel 12, being received in one of the aforementioned longitudinal slots 19 and 20 that are formed in the interior of the housing 11. This prevents the rotational movement of the lock barrel 12 in the housing 11 for the locking and unlocking thereof. Furthermore, in this position the control tumbler 13 also extends from the diameter 14 being received in the annular clearance slot 18 that is either formed in, or defined behind the housing 11, as is perhaps most clearly represented in the end views (FIGS. 2B and 3B).

Figure 2A:
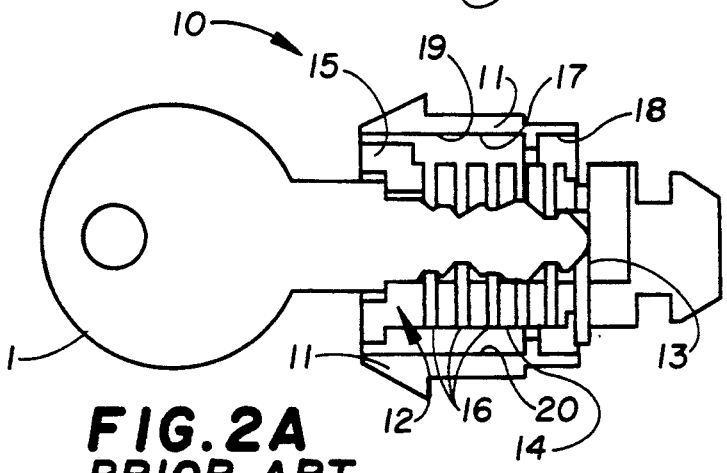
FIG. 2A PRIOR ART
FIG. 2A is a longitudinal cross-section of the conventional lock of FIG. 1A, with a normal key inserted therein.
Figure 2B:
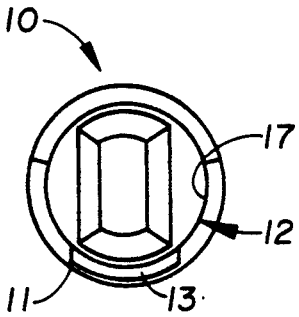
FIG. 2B PRIOR ART
FIG. 2B is an end view of the lock of FIG. 2A.

With reference now to FIGS. 2A and 2B, in the conventional lock 10 described above, with the introduction (insertion) of a first normal key 1 having a first bitted portion into the barrel, at least a portion of the sliding tumblers 16 are returned (urged) to the respective activated positions thereof wherein the tumblers 16 are withdrawn into the barrel 12, in a manner known to those skilled in the art. As illustrated herein, these activated positions are retracted relative to the barrel 12, so that the tumblers 16 are positioned at the level of the diameter 14 of the body 15 of the barrel 12. In this activated position, the rotation of the barrel assembly 12 between the first locking and the second unlocking positions is permitted for the locking and unlocking of the lock by use of the normal key 1.

Because in such arrangements, the point of the key 1 freely enters into a central opening formed in the control tumbler 13, said 12 key either does not or only slightly touches an edge of the control tumbler 13, such that the control tumbler 13 is not completely withdrawn into the body 15 of the barrel assembly 12 or slid into the activated position. Thus, the control tumbler 13 is not sufficiently displaced and substantially remains in the eccentric first resting position, thereby retaining the barrel 12 in the housing 11 by abutting with the front wall of the annular clearance space 18 in a manner that is well known by those skilled in the art, and as is perhaps most clearly shown in the FIG. 2B.

Figure 3A:
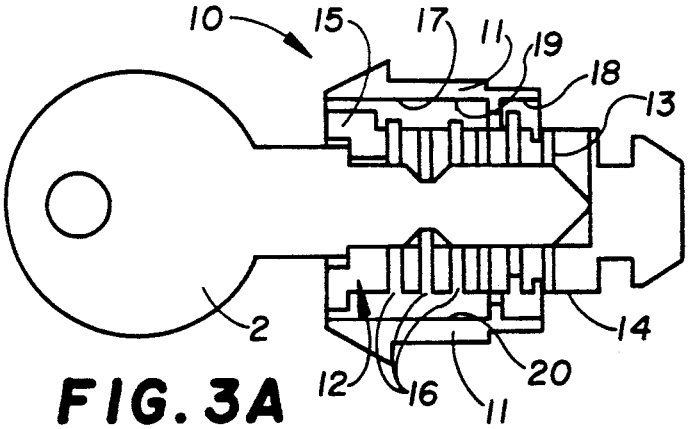
FIG. 3A PRIOR ART
FIG. 3A is a longitudinal cross-section of the conventional lock of FIG. 1A, with a removal key inserted therein.
Figure 3B:
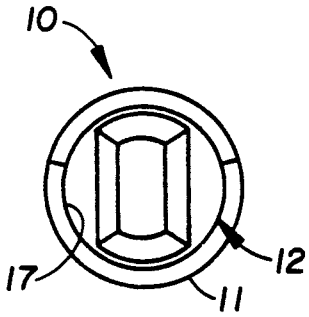
FIG. 3B PRIOR ART
FIG. 3B is an end view of the lock of FIG. 3A.

With reference now to FIGS. 3A and 3B, in the conventional lock 10 described above, with the introduction (insertion) of a second, control key extraction key 2 having a portion with a simplified contours, this portion contacts the control tumbler 13. This collaboration slidingly displaces (retracts) the control tumbler 13 inwardly relative to the body 15 (in FIGS. 3A and 3B in an upwardly direction) until the edge of the control tumbler 13 is in the activated position, wherein said edge at least coincides with the diameter 14 of the body 15 of the barrel 12.

If a one-ended control tumbler 13 is utilized, then upon insertion of the control key 2, the barrel 12 may then be removed from the housing 11. However, if a double-ended control tumbler 13 is utilized, then the lock must be in the unlocked position in order to be withdrawn from the housing 11.

Because this removal key 2 does not possess the contours that are typical of the normal key 1, at least a portion of the tumblers 16 remain in the resting positions thereof, not being withdrawn into the respective activated positions thereof (which, as illustrated, are within the body 15 of the barrel 12). Thus, rotation of the barrel 12 in the housing 11, such as is necessary for locking and unlocking of the lock 10 by use of this key 1, is prevented.

With reference now to FIGS. 4A–8B, a first embodiment of a lock 10 according to the present invention is discussed.

The housing 11 of the lock 10 has an internal longitudinal nib slot 21 formed therein, so as to extend from a forward portion of the housing 11 to the annular clearance space 18, so as to be in communication therewith. At least one nib 22 is formed on the lock barrel 12. The nib 22 is disposed on a portion of the barrel 12, such that when the barrel 12 is disposed in the housing 11, the nib 22 is received in the clearance space 18, permitting rotation of the barrel 12 in the housing 11 between the first locking and the second unlocking positions. The nib 22 is further positioned, so as to be substantially aligned with the nib slot 21 only when the barrel 12 is in the second unlocking position.

In the above manner, when the lock 10 is in the locked position (FIGS. 6A, 6B, 8A and 8B), the barrel 12 will be retained in the housing 11 by the nib 22 abutting a section of the housing 11 that is defined by the front of the annular clearance space 18. This is true regardless if the normal key 1 (FIGS. 6A and 6B) or the control key 2 (FIGS. 8A and 8B) is inserted.

Figure 4A:
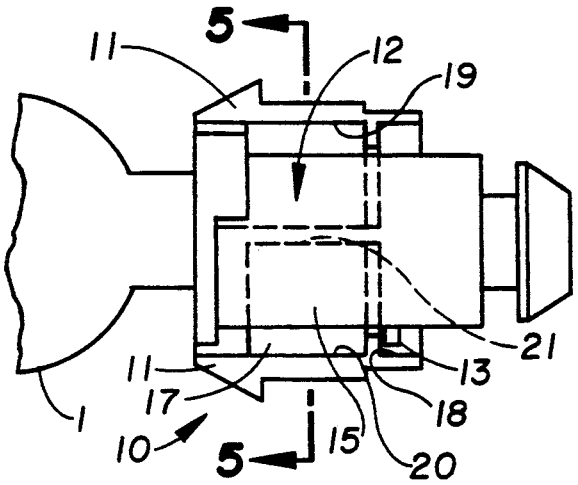
FIG. 4A is a longitudinal cross-section of a first embodiment of the lock of the present invention with the lock barrel thereof in an unlocked (open) position, with the normal key inserted therein and with the longitudinal nib slot formed in the housing being illustrated in phantom lines for the sake of clarity.
Figure 4B:
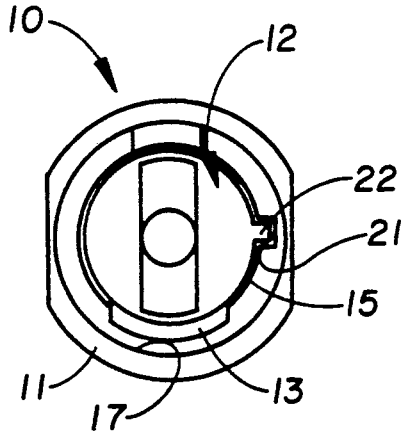
FIG. 4B is an end view of the lock of FIG. 4A.
Figure 5:
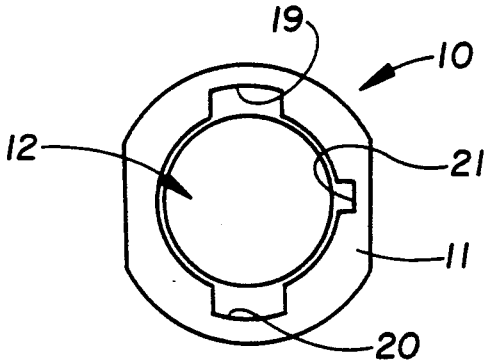
FIG. 5 is a cross-section view of the first embodiment of the lock of the present invention taken along lines 5—5 of FIG. 4A.
Figure 6A:
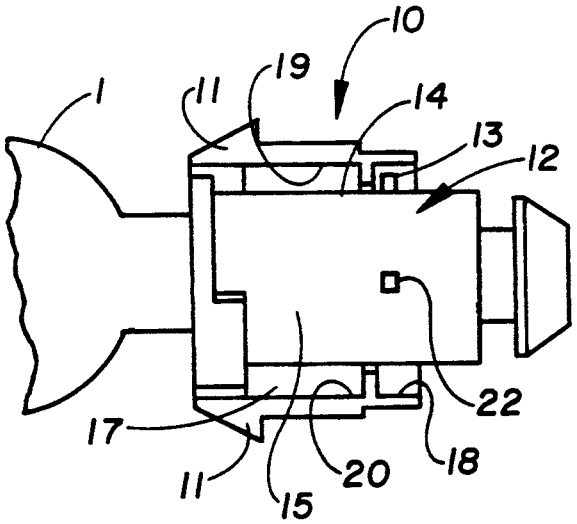
FIG. 6A is a longitudinal cross-section view of the first embodiment of the lock of the present invention with the lock barrel thereof in a locked (closed) position and with the normal key inserted therein.
Figure 6B:
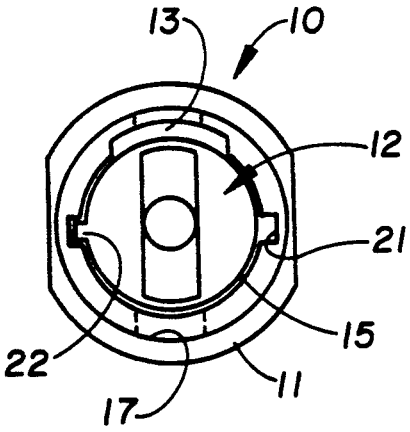
FIG. 6B is an end view of the lock of FIG. 6A.
Figure 7A:
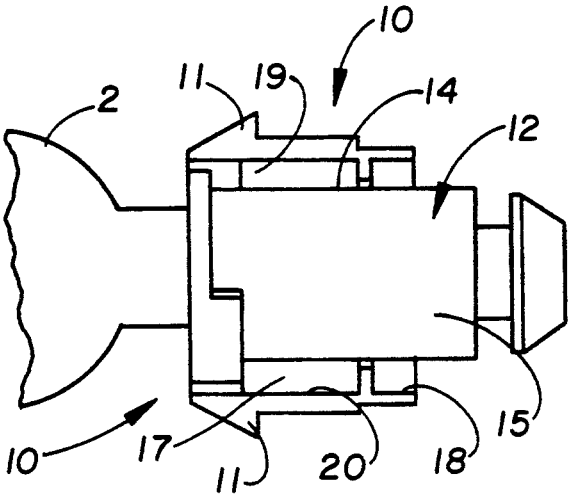
FIG. 7A is a longitudinal cross-section view of the first embodiment of the lock of the present invention with the lock barrel thereof in a unlocked (open) position and with the control key inserted therein.
Figure 7B:
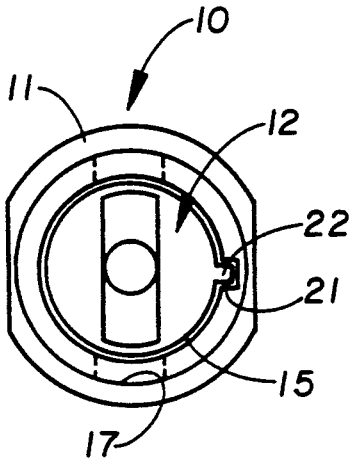
FIG. 7B is an end view of the lock of FIG. 7A.
Figure 8A:
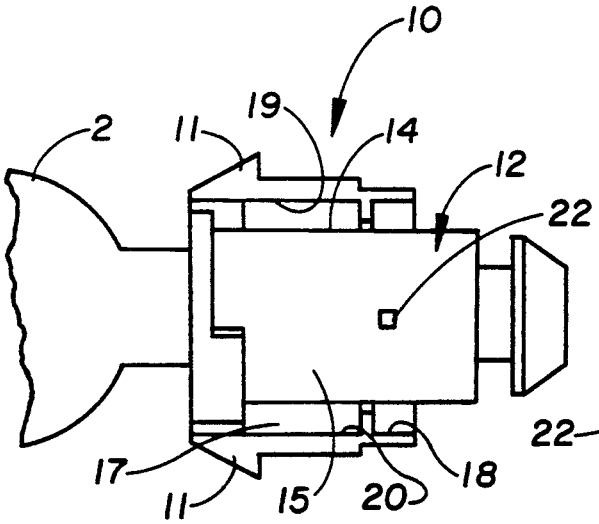
FIG. 8A is a longitudinal cross-section view of the first embodiment of the lock of the present invention with the lock barrel thereof in a locked (closed) position and with the control key inserted therein.
Figure 8B:
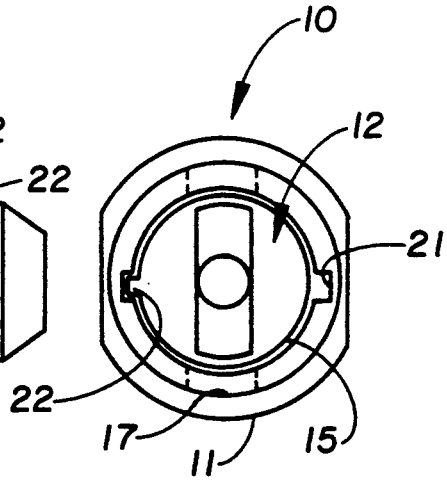
FIG. 8B is an end view of the lock of FIG. 8A.

Further in the above manner, when a control tumbler 13 is provided, even when the lock is in the unlocked position (FIGS. 4A, 4B, 7A and 7B), the barrel 12 will only be able to be removed from the housing 11 when both the control key 2 is utilized and when the barrel 12 is in the unlocking position. As can be seen in FIGS. 4A and 4B, even when the barrel 12 is in the unlocking position, if only the normal key 1 is utilized, the barrel 12 will still be retained in the housing 11 by the control tumbler 13 abutting the front surface of the annular clearance slot 18. As can be seen in FIGS. 7A and 7B, only when both the barrel 12 is in the unlocking position and when the control key 2 is inserted, with the barrel 12 be able to be removed from the housing 11.

With reference now to FIGS. 9A–12B, a second embodiment of a lock 10 according to the present invention is discussed.

The barrel 12 of the lock 10 has a second annular clearance slot 23 formed therein. The barrel 12 also has a longitudinal nib slot 21 formed therein, so as to extend from the rearward end of the barrel 12 to the annular clearance space 23, so as to be in communication therewith. A nib 22 is formed on interior of the housing 11. The nib 22 is disposed on a portion of the housing 11, such that when the barrel 12 is disposed in the housing 11, the nib 22 is received in the clearance space 23. In this manner, rotation of the barrel 12 in the housing 11 between the first locking and the second unlocking positions is permitted. The nib 22 is further positioned, so as to be substantially aligned with the nib slot 21 only when the barrel 12 is in the second unlocking position.

It is noted that, preferably, the slot 23 extends substantially about half of the circumference of the lock barrel 12. Formed in this manner, the slot 23 terminates in respective ends, so as to define respective nib stops 24 at either end thereof. These nib stops 24 are positioned or located so that the nib 22 abuts the one of the nib stops 24 when the barrel 12 is in the first locking position and further so that the nib 22 abuts the other of the nib stops 24 when the barrel 12 is in the second unlocking position. In this fashion, the nib stops 24 provide a mechanical means, whereby the user may insure that he has moved the barrel 12 into the desired position thereof for, for example, insuring that the nib 22 is aligned with the nib slot 21 for removal of the barrel 12 from the housing 11.

If desired, the slot 23 may also be formed so as to extend about substantially the entire circumference of the barrel 12.

In the above manner, when the lock 10 is in the locked position (FIGS. 10A, 10B, 12A and 12B), the barrel 12 will be retained in the housing 11 by the nib 22 abutting a section of the barrel 12 that is defined by the front of the annular clearance space 23. This is true regardless if the normal key 1 (FIGS. 10A and 10B) or the control key 2 (FIGS. 12A and 12B) is inserted.

Figure 9A:
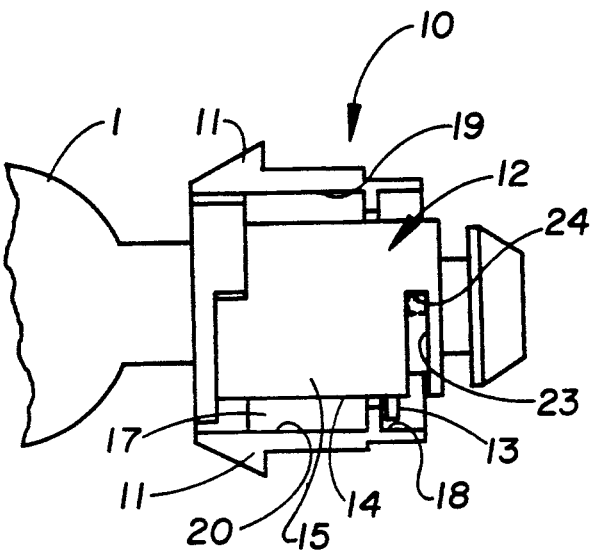
FIG. 9A is a longitudinal cross-section view of a second embodiment of the lock of the present invention with the lock barrel thereof in the unlocked (open) position and with the normal key inserted therein.
Figure 9B:
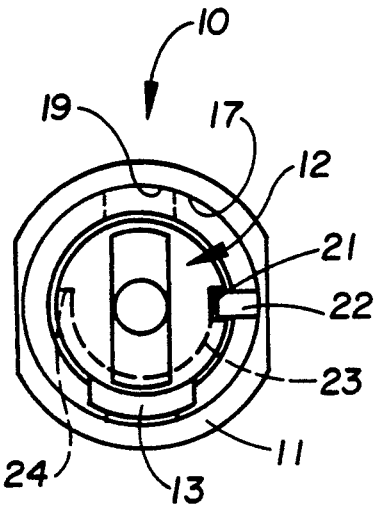
FIG. 9B is an end view of the lock of FIG. 9A.
Figure 10A:
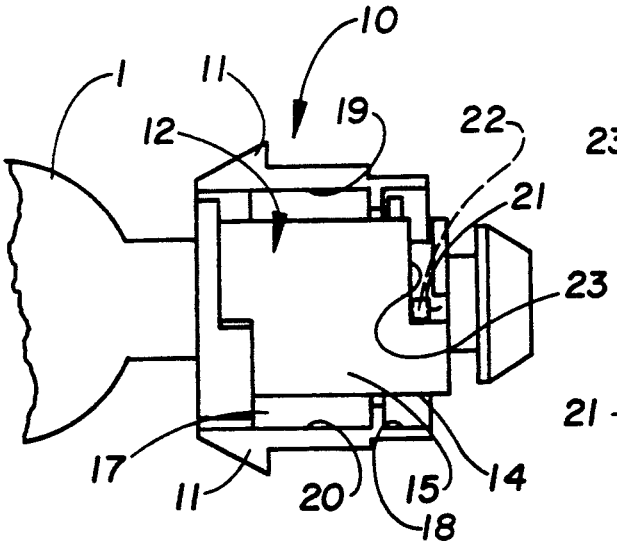
FIG. 10A is a longitudinal cross-section view of the second embodiment of the lock of the present invention with the lock barrel thereof in the locked (closed) position and with the normal key inserted therein.
Figure 10B:
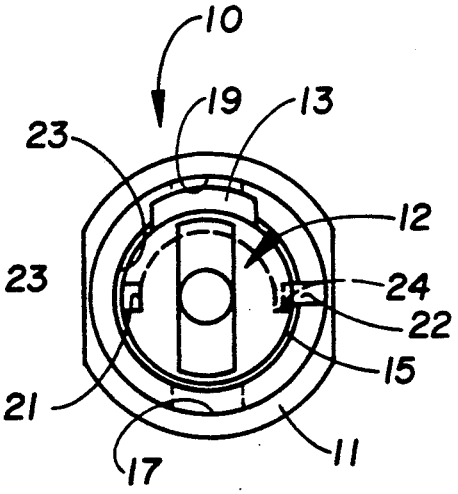
FIG. 10B is an end view of the lock of FIG. 10A.
Figure 12A:
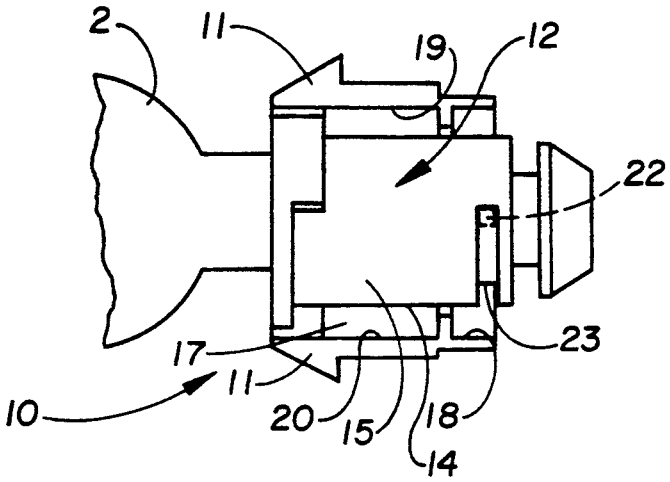
FIG. 12A is a longitudinal cross-section view of the second embodiment of the lock of the present invention with the lock barrel thereof in the locked (closed) position and with the control key inserted therein.
Figure 12B:
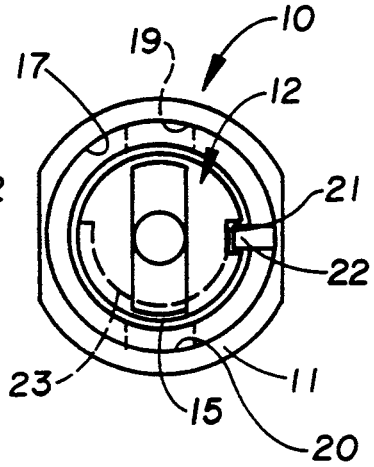
FIG. 12B is an end view of the lock of FIG. 12A.
Figure 11A:
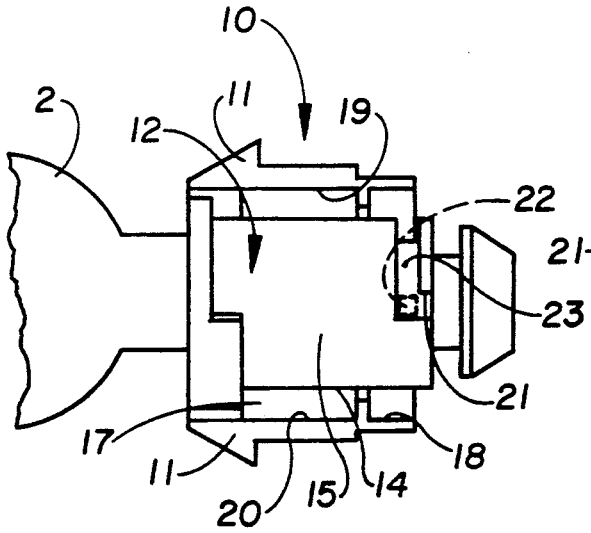
FIG. 11A is a longitudinal cross-section view of the second embodiment of the lock of the present invention with the lock barrel thereof in the unlocked (open) position and with the control key inserted therein.
Figure 11B:
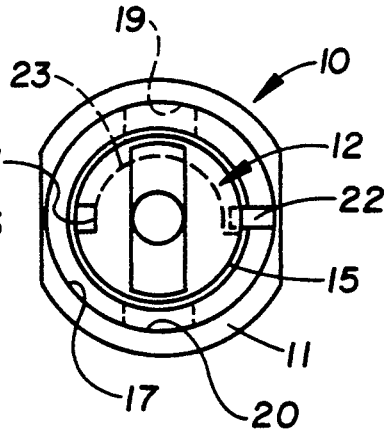
FIG. 11B is an end view of the lock of FIG. 11A.

Further in the above manner, when a control tumbler 13 is provided, even when the lock is in the unlocked position (FIGS. 9A, 9B, 11A and 11B), the barrel 12 will only be able to be removed from the housing 11 when both the control key 2 is utilized and when the barrel 12 is in the unlocking position. As can be seen in FIGS. 9A and 9B, even when the barrel 12 is in the unlocking position, if only the normal key 1 is utilized, the barrel 12 will still be retained in the housing 11 by the control tumbler 13 abutting the front surface of the annular clearance slot 18. As can be seen in FIGS. 11A and 11B, only when both the barrel 12 is in the unlocking position and when the control key 2 is inserted, will the barrel 12 be able to be removed from the housing 11.

Having thus described the present invention, it will be understood by those skilled in the art that, within the scope of the appended claims, the invention may be practiced other than has been specifically described herein. For example, if desired, more than one nib and corresponding nib slots therefor may be utilized as desired to provide further strength and security. Also, if desired, nibs as well as nib slots and annular clearance slots may be formed on both the barrel and the housing in the same embodiment.

What is claimed is:

1. A cylinder lock having a removable lock barrel and keys therefor, the combination comprised of:

a lock barrel including a plurality of sliding combination tumblers disposed in the barrel for sliding movement between respective first resting positions and second activated positions;

a housing having a bore formed therethrough for rotatably receiving the barrel therein, the housing further having a first internal longitudinal slot formed therein extending from a forward end of the housing, and a second internal longitudinal slot formed extending from a forward end of the housing, the first slot and the second slot further being formed in the housing, so as to be substantially diametrically opposite of the first slot, the housing further including an annular clearance space;

such that when the barrel is disposed in the housing with the combinating tumblers in the respective activated positions thereof, the barrel may rotate between a first locking position and a second unlocking position; and further such that when the barrel is disposed in the housing in either the first locking position or the second unlocking position with at least a portion of the combinating tumblers in the respective resting positions thereof, the combinating tumblers in the resting positions are received in at least one of the first and second longitudinal slots for preventing rotational movement of the lock barrel in the housing between the locking and unlocking positions thereof;

the lock barrel further including a sliding control tumbler having a first end, the control tumbler being disposed in the barrel for sliding movement between a first resting position, wherein the first end is extended relative to the barrel, and a second activated position, wherein the first end is retracted relative to the barrel;

means for constantly resiliently biasing the control tumbler into the first resting position thereof;

the housing further including an annular clearance space for accommodating extension of the first end of the control tumbler in the first resting position, whereby the barrel is retained in the housing, and further whereby rotational movement of the lock barrel between the first locking position and the second unlocking position is permitted;

a first normal key having a bitted portion, such that when inserted into the barrel the bitted portion contacts the combinating tumblers, thereby moving the combinating tumblers from the first resting positions thereof and into the second activated positions thereof, whereby the barrel may be rotated between the first locking position and the second unlocking position;

a second control key having a contoured portion, such that when inserted into the barrel the contoured portion contacts the control tumbler, thereby moving the control tumbler from the first resting position and into the second activated position without moving the combinating tumblers into the respective second activated positions thereof;

a nib formed on the lock barrel;

a third longitudinal nib slot formed in the housing extending from a forward end of the housing to the annular clearance space, so as to be in communication therewith;

such that when the lock barrel is disposed in the housing, the nib is received in the annular clearance space permitting the rotation of the barrel in the housing between the first locking position and the second unlocking position; and the nib positioned so as to be substantially aligned with the third longitudinal nib slot only when the lock barrel is in the second unlocking position, whereby the lock barrel may be removed from the housing only when the second key is inserted into the barrel after the barrel has been placed in the unlocked position;

such that the lock barrel can not be removed from the lock barrel with the first key inserted therein; and further such that the lock barrel can not be rotated between the first locking position and the second unlocking position with the second key inserted therein;

whereby the lock barrel may be removed from the housing only when both the control tumbler has been moved into the activated position with the second key and when the lock barrel is rotated into the second unlocking position with the first key.

2. The cylinder lock of claim 1, wherein the annular clearance space is an annular clearance slot formed in the housing.

3. The cylinder lock of claim 2, wherein the annular clearance slot is formed in a rearward portion of the housing.

4. A cylinder lock having a removable lock barrel and keys therefor, the combination comprised of:

a lock barrel including a plurality of sliding combinating tumblers disposed in the barrel for sliding movement between respective first resting positions and second activated positions;

a housing having a bore formed therethrough for rotatably receiving the barrel therein, the housing further having a first internal longitudinal slot formed therein extending from a forward end of the housing, and a second internal longitudinal slot formed extending from a forward end of the housing, the first slot and the second slot further being formed in the housing, so as to be substantially diametrically opposite of one another;

such that when the barrel is disposed in the housing with the combinating tumblers in the respective activated positions thereof, the barrel may rotate between a first locking position and a second unlocking position; and further such that when the barrel is disposed in the housing in either the first locking position or the second unlocking position with at least a portion of the combinating tumblers in the respective resting positions thereof, the combinating tumblers in the resting positions are received in at least one of the first and second longitudinal slots for preventing rotational movement of the lock barrel in the housing between the locking and unlocking positions thereof;

the lock barrel further including a sliding control tumbler having a first end, the control tumbler being disposed in the barrel for sliding movement between a first resting position, wherein the first end is extended relative to the barrel, and a second activated position, wherein the first end is retracted relative to the barrel;

means for constantly resiliently biasing the control tumbler into the first resting position thereof;

the housing further including an annular clearance space for accommodating extension of the first end of the control tumbler in the first resting position, so that the barrel is retained in the housing, whereby rotational movement of the lock barrel between the first locking position and the second unlocking position is permitted;

a first normal key having a bitted portion, such that when inserted into the barrel the bitted portion contacts the combinating tumblers, thereby moving the combinating tumblers from the first resting positions thereof and into the second activated positions thereof, whereby the barrel may be rotated between the first locking position and the second unlocking position;

a second control key having a contoured portion, such that when inserted into the barrel the contoured portion contacts the control tumbler, moving the control tumbler from the first resting postion and into the second activated position without moving the combinating tumblers into the respective second activated positions thereof;

a nib formed on the interior of the housing;

the lock barrel having an a second annular clearance space formed therein;

a third longitudinal nib slot formed in the lock barrel extending from a rearward end of the barrel to the annular clearance space, so as to be in communication therewith;

such that when the lock barrel is disposed in the housing, the nib is received in the second annular clearance space permitting the rotation of the barrel in the housing between the first locking position and the second unlocking position; and the nib positioned so as to be substantially aligned with the third longitudinal nib slot only when the lock barrel is in the second unlocking position, whereby the lock barrel may be removed from the housing only when the second key is inserted into the barrel after the barrel has been placed in the unlocked position;

such that the lock barrel can not be removed from the lock barrel with the first key inserted therein; and further such that the lock barrel can not be rotated between the first locking position and the second unlocking position with the second key inserted therein;

whereby the lock barrel may be removed from the housing only when both the control tumbler has been moved into the activated position with the second key and when the lock barrel is rotated into the second unlocking position with the first key.

5. The cylinder lock of claim 4, wherein the annular clearance space is an annular clearance slot that is formed in the lock barrel so as to extend about substantially the entire circumference of the lock barrel.

6. The cylinder lock of claim 4, wherein the annular clearance space is an annular clearance slot that is formed in the lock barrel so as to extend about substantially half of the circumference of the lock barrel.

7. The cylinder lock of claim 6, wherein the annular clearance space is an annular clearance slot that is formed in the lock barrel and which terminates in respective ends so as to define respective nib stops, said nib stops being positioned, so that during rotation the nib abuts the one of the nib stops when the lock barrel in the first locking position and further so that the nib abuts the other of the nib stops when the lock barrel in the second unlocking position.

8. The cylinder lock of claim 4, wherein the annular clearance space is an annular clearance slot formed in a rearward portion of the lock barrel.

* * * * *